United States Patent [19]

Bennett

[11] 4,035,898

[45] July 19, 1977

[54] BLIND RIVET ASSEMBLING

[75] Inventor: Milton Bennett, Bridgewater, Mass.

[73] Assignee: Philstone Nail Corporation, Canton, Mass.

[21] Appl. No.: 610,172

[22] Filed: Sept. 4, 1975

[51] Int. Cl.[2] ..... B23P 19/04

[52] U.S. Cl. ..... 29/788; 29/818

[58] Field of Search ..... 29/208 F, 211 R, 211 D, 29/243.53

[56] References Cited

U.S. PATENT DOCUMENTS

| | | | |
|---|---|---|---|
| 2,914,781 | 12/1959 | Prutton | 29/211 R |
| 3,100,307 | 8/1963 | Hatherell et al. | 29/211 R |
| 3,364,553 | 1/1968 | DiMaio | 29/211 D |
| 3,461,535 | 8/1969 | Avery et al. | 29/208 F |
| 3,675,301 | 7/1972 | McQuary et al. | 29/208 F |
| 3,750,256 | 8/1973 | Elmer | 29/208 F |
| 3,845,537 | 11/1974 | Ayers et al. | 29/208 F |

*Primary Examiner*—James L. Jones, Jr.

*Attorney, Agent, or Firm*—Wolf, Greenfield & Sacks

[57] ABSTRACT

A machine for automatically assembling the tubular rivet and pin of a blind rivet assembly. The tubular rivets and pins are fed from supply hoppers along a pair of chutes, one of which carries a sequence of rivets and the other of which carriesa sequence of pins. The chutes terminate at a pair of rotatably indexable turrets which have peripheral configurations adapted to pick off and carry the rivets and pins from the ends of their respective chutes. The turrets are rotatably indexed to bring the rivets and pins sequentially to an assembly station at which the pin and rivet are axially aligned with each other and in readiness to enable the pin to be driven into and through the tubular rivet. A hammering mechanism is employed to drive the pin through the sleeve to a finally assembled configuration with the sleeve and the assembled pin and rivet then are ejected from the machine.

9 Claims, 10 Drawing Figures

BLIND RIVET ASSEMBLING

BACKGROUND OF THE INVENTION

This invention relates to so-called blind rivets which typically include a tubular sleeve having an enlarged flange integral with and at one end of the sleeve. A headed pin is passed through the tube with the head in engagement with the tubular end of the rivet and with the other end of the pin extending out of the other end of the tube and beyond the flange portion. In use, the rearwardly extending end of the pin is gripped by a tool which is manipulated to insert the head and tube end of the rivet assembly into a preformed hole in the work piece with the flange of the rivet bearing against the work piece. The tool is then operated to forceably drive the pin rearwardly while maintaining the flange of the rivet in firm abutment with the work piece. As the pin is drawn rearwardly, its head causes the tubular end of the rivet to flare outwardly and to be drawn firmly against the inside surface of the work piece. When the tubular portion of the rivet is flared fully, additional pulling force is applied to the pin which causes it to break at a weakened region near the head, thus enabling withdrawal of the pin from the rivet.

Among the important steps in the manufacture of such blind rivets is the assembly of the pins and rivets so that they can be packaged in a ready-to-use configuration. While a number of machines and devices are believed to have been employed for automatically assembling the rivets and pins, the maximum speed of these machines has been limited to far less an assembly rate than is desirable. By way of example, few, if any such assembly machines have been capable of approaching a rate of 200 units per minute. Efforts to surpass such an assembly speed are believed to have failed in that the machines tend to jam or may improperly assemble or damage the rivets.

SUMMARY OF THE INVENTION

The pins and tubular rivets each are fed from supply hoppers along inclined chutes to a pair of rotatably indexable turrets. One of the turrets has specially formed grooves in its periphery to receive and pick up the leading rivet from the rivet chute and to transfer the rivet to an assembly station where it may be combined with the pin. The outer turret similarly has specially formed grooves at its periphery which sequentially pick up the leading pins from the pin chute and transfer the pins, sequentially, to the combining station in readiness to be combined with a similarly indexed tubular rivet. Means are provided for retaining the pins and rivets in the peripheral grooves of their respective turrets while the turrets are rotatably indexed toward the combining station. The turrets are arranged so that for each indexed position a pin and tubular rivets will be axially aligned with each other in readiness for the pin to be driven into and through the rivet. When at the assembly station, a hammer drives the pin from its head end partly into the rivet and in a manner which maintains the pin in axial alignment with the rivet. As the turrets continue to index to their succeeding positions, the partly assembled rivets and pins are further combined, in increments, by a succession of hammers disposed at the plurality of successive indexing stations, each hammer driving the pin a further increment into engagement with the rivet. The last hammer in the sequence drives the pin to its fully assembled position. The assembled pin and rivet then are ejected at the next indexed station.

It is among the objects of the invention to provide an improved method and apparatus for assembling the tubular rivet and pin of a blind rivet.

A further object of the invention is to provide a method and apparatus of the type described in which relatively high assembly speeds can be obtained.

A further object of the invention is to provide a method and apparatus for assembling a tubular rivet and pin of a blind rivet assembly in which the chance of the machine becoming jammed or the rivet parts becoming damaged is minimized.

A further object of the invention is to provide a method and apparatus for assembling a tubular rivet and pin of a blind rivet in which the pin and rivet are combined in a series of successive and incremental hammering stages.

A further object of the invention is to provide an improved method and apparatus for bringing a tubular rivet and pin of a blind rivet into alignment with each other in readiness to be assembled.

DESCRIPTION OF THE DRAWINGS

The foregoing and other objects and advantages of the invention will be understood more fully from the following further description thereof, with reference to the accompanying drawings wherein.

DESCRIPTION OF THE PRFERRED EMBODIMENT

Figure 1:
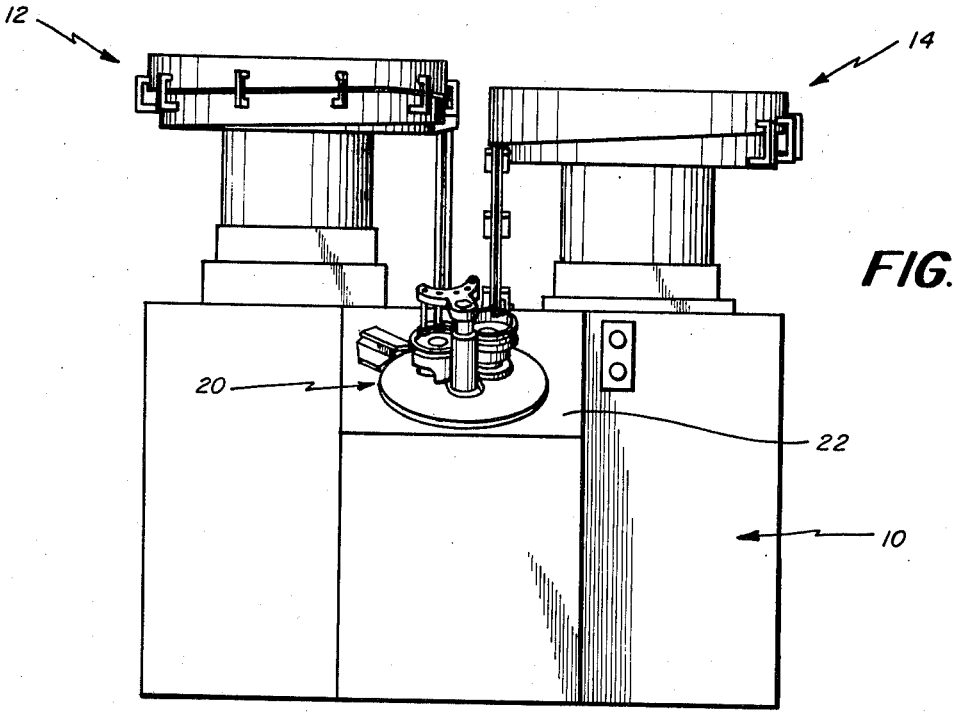
FIG. 1 is a front elevation of the assembly machine.
Figure 2:
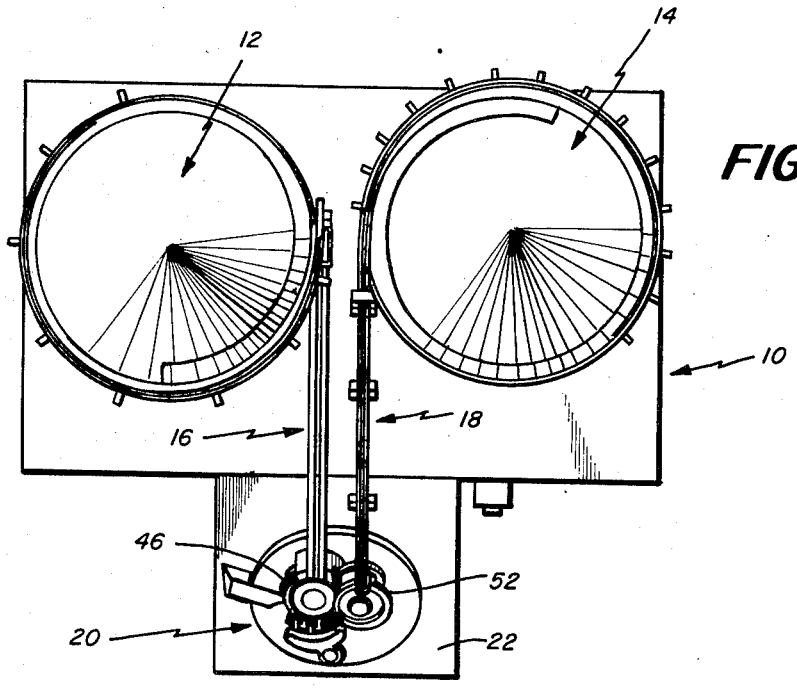
FIG. 2 is a plan view of the machine.

As shown in FIGS. 1 and 2, the machine includes a base 10 which supports a pair of elevated hoppers 12, 14. One of the hoppers, for example, hopper 12 is intended to receive a multiplicity of loose tubular rivets and the other hopper 14 is intended to receive a multiplicity of loose nail-like pins. The hoppers 12, 14 may be of the vibratory type in which high freqency vibrations are applied to the hopper to cause the loose parts contained in the hopper to be advanced along a predetermined ramp or other guiding surface in series. A variety of such feeding mechanisms have been employed and are commercially available. The hoppers 12, 14 are arranged to deliver a continuous supply of tubular rivets and nails (pins) to a rivet chute 16 and a pin chute 18, respectively. The chutes 16, 18 are inclined downwardly and forwardly from their respective hoppers and terminate at their lower ends at an assembly mechanism, indicated generally by the reference character 20.

The assembly mechanism 20 is mounted on a forwardly extending table portion 22 which, in the embodiment shown, is inclined somewhat downwardly and forwardly.

Figure 7:
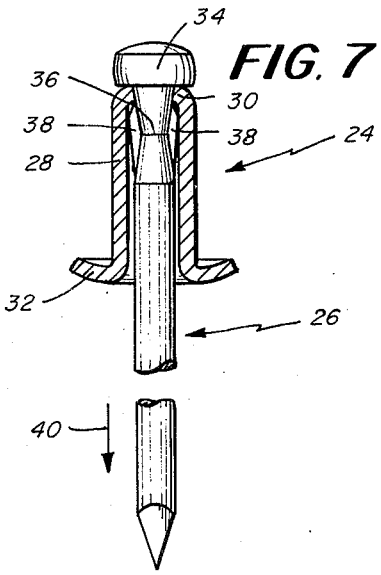
FIG. 7 is an enlarged sectional elevation of an assembled pin and tubular rivet.

FIG. 7 illustrates, in an assembled relation, the configuration of the tubular rivet indicated generally at 24 and pin indicated generally at 26. The rivet 24 includes an elongate tubular portion 28 having a slightly restricted opening at its upper end as defined by a slightly inwardly extending lip portion 30. The other end of the rivet 24 is preformed to define a flange portion 32. The pin 26 has an enlarged head 34 formed at its upper end, the underside of the head being adapted to bear against the lip portion 30 of the rivet24 when the rivet and pin are assembled. The pin 26 has a narrowed waist portion 36 formed just below the head 34 to define a relatively weak, tensile region where the pin may break after the riveting operation has been completed. One or more longitudinal, thin ribs 38 extend along a portion of the waist 36 and help to retain the pin 26 and rivet 24 together by retarding withdrawal of the pin from the rivet 24. The rivet assembly is used by inserting the lower (pointed) end of the pin 26 into a special tool which then is manipulated to insert the combined pin and rivet into a preformed hole in a workpiece so that the flange 32 bears against the outer surface of the workpiece. The tool then is operated to hold the flange 32 against the outer surface of the workpiece while, at the same time, draws the pin in the direction suggested by the arrow 40 in FIG. 7. The configuration of the rivet tube 28, lip 30 and head 34 of the pin 26 is such that when the pin is so drawn, the tubular end of the rivet will flare outwardly under the influence of the head 34 and will be drawn into firm engagement with the inner surface of the workpiece. The tool is designed to continue exerting an axial, drawing force on the pin 40 until the pin breaks at its waist 36 thus enabling removal of the pin portion and leaving the riveted workpiece.

In the assembly of the rivet 24 and pin 276, it is extremely important that the configuration of the tube portion 28 of the rivet and particularly the lip portion 30 remain substantially undeformed. The symmetrical flaring and expansion of the tubular portion 28 of the rivet is in large part dependent on the assembly having its proper relative configurations. Should the tubular portion of the rivet or the lip portion 30 become deformed, this could result in malfunction of the rivet device in use or a poorly formed rivet. It is very important, therefore, that when the rivets and pins are assembled, the assembly should be done in a manner which minimizes any tendency of the configuration of the rivet to be deformed. This has been a difficult task because the rivets and pins generally are of relatively fragile construction as compared to the machinery which is employed to assemble them. For example, even a slight misalignment of the pin and rivet during their assembly could damage the rivet configuration and preclude its proper functioning.

The rivets 24 are gravity fed downwardly along the rivet chute 16 in a flange-down, tube-up attitude. The rivet chute 16 includes a bottom plate 42 (FIG. 4) and a pair of L-shaped top plates 44 which define a channel of inverted T-shaped configuration through which the rivets may pass. The outer, forward end of the rivet chute 16 is formed to define a spherical surface which lies closely spaced to the periphery of a rotatably indexable rivet turret indicated generally by reference character 46. As will be described, the rivet turret 46 has a plurality of circumferentially spaced grooves formed in its periphery which receive the leading rivet in the chute. The rivet turret 46 is rotatably indexed in increments such that each time the turret stops at an indexed position, one of its peripheral grooves will be in alignment with the rivet chute and will receive the leading rivet from the chute.

The pin chute 18 includes a pair of parallel bars 48 which are spaced to receive the stems of the pins but to support the pins by their heads 34. As the pins gravitate downwardly and forwardly along the pin chute 18, they assume a generally vertical attitude and the heads rest one against the other. The outer end of the pin chute 18 is provided with a generally L-shaped stop 50 which precludes the pins from continually flowing out of the chute 18 yet which is sufficiently spaced from the end of the chute to permit the pins to be withdrawn individually from the end of the chute in a lateral direction. The pins are picked off individually from the leading end of the chute by a rotatably indexable pin turret indicated generally by the reference character 52. The pin turret 52 similarly has a plurality of circumferentially spaced grooves formed at its periphery which receive the pins in a manner generally similar to that in which the rivet turret 46 receives the rivets 24.

Figure 3:
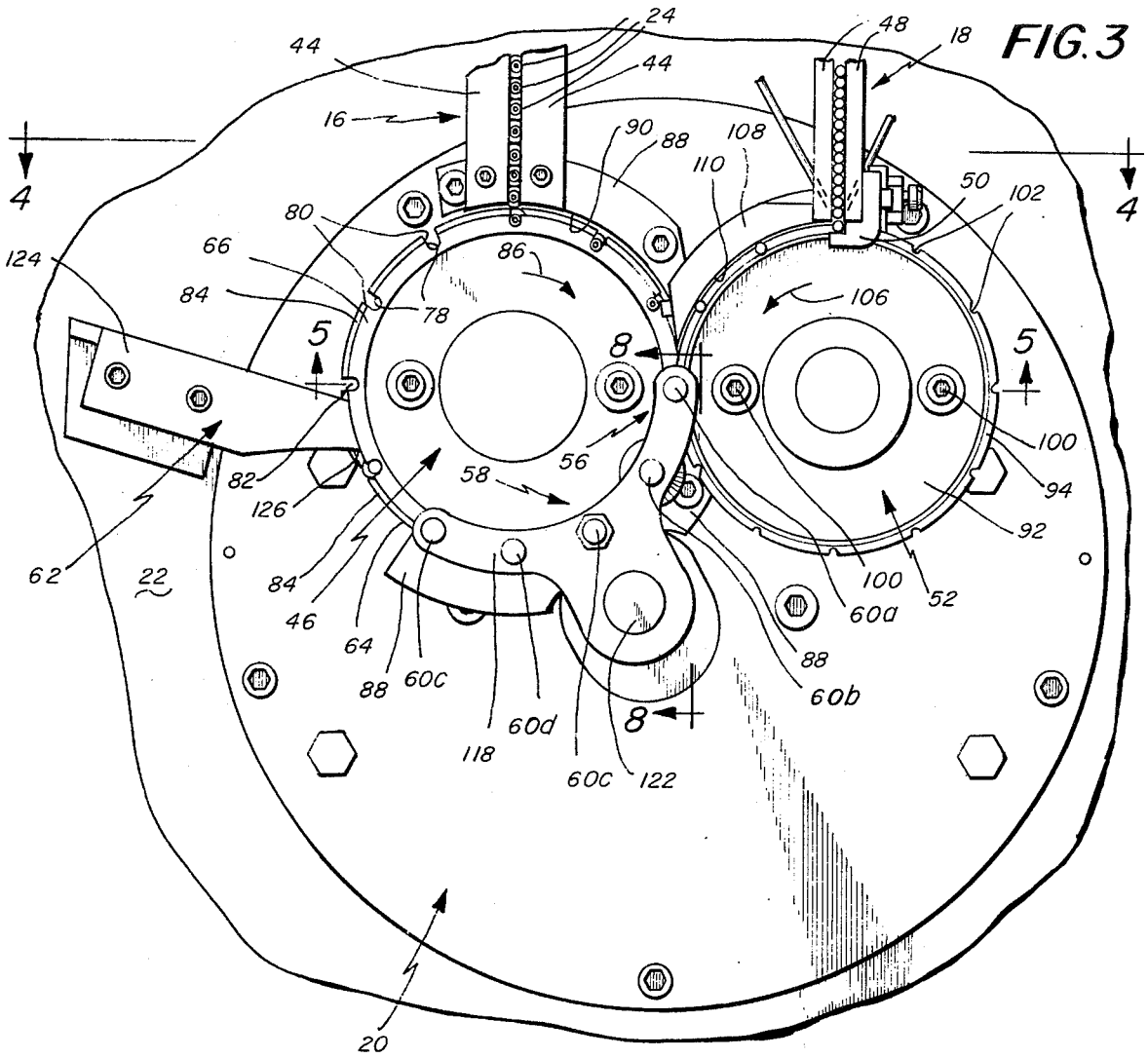
FIG. 3 is a plan view of the turret assembly mechanism.
Figure 5:
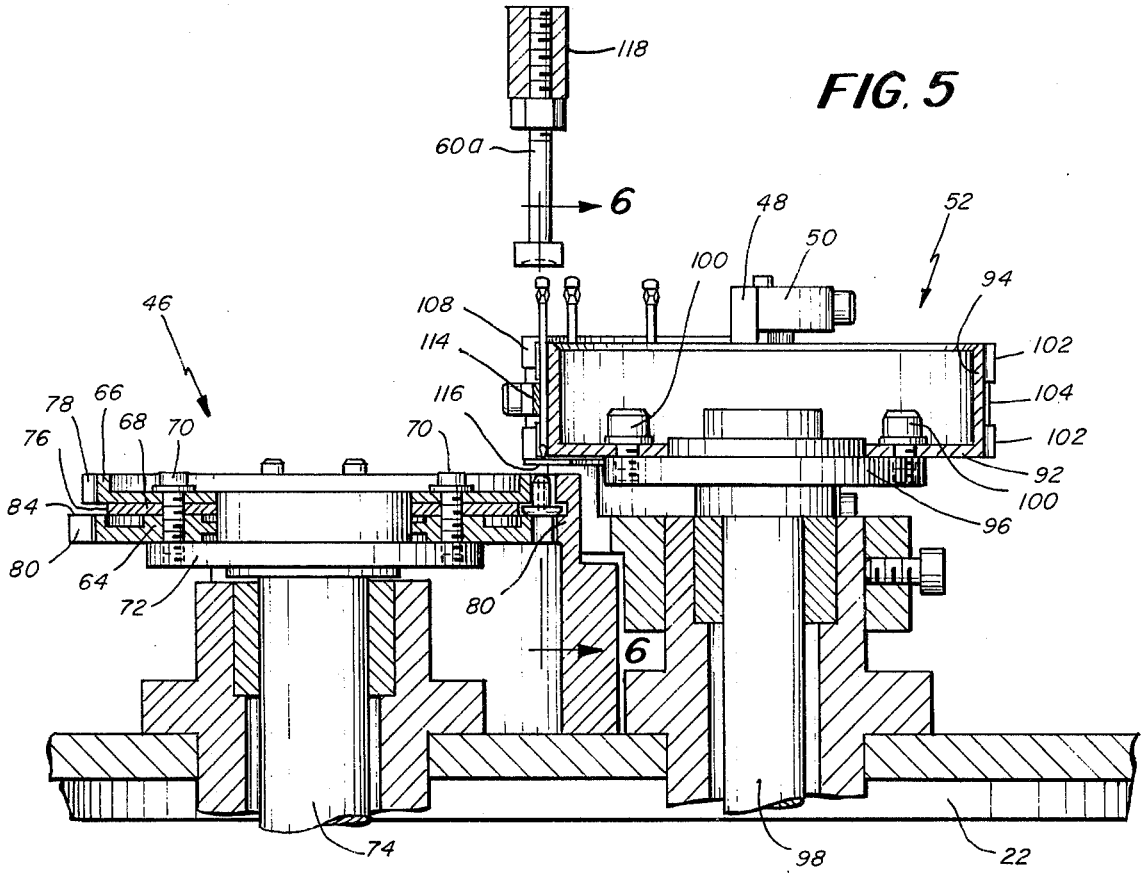
FIG. 5 is a sectional elevation of the turret mechanism as seen along the line 5—5 of FIG. 3.
Figure 6:
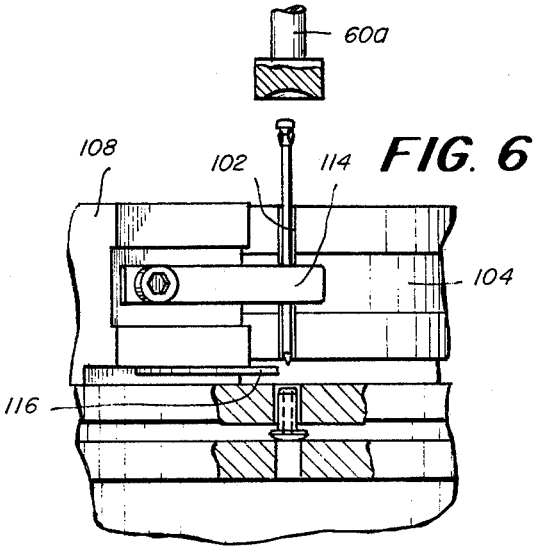
FIG. 6 is a sectional elevation of a segment of the turret assembly as seen along the line 6—6 of FIG. 5.

As can be seen in FIG. 5, the pin turret 52 is disposed above the rivet turret 46 and each is mounted for incremental rotation (the rivet turret 46 being driven clockwise as seen in FIG. 3 and the pin turret being driven counterclockwise) by a drive mechanism 54 mounted below the table 22. The turrets 46, 52 are disposed so that their peripheral regions will overlap at an assembly station 56 in which the pin will be held over and in axial alignment with the rivet as suggested in FIG. 5.

When a pin and rivet are at the assembly station 56 as shown in FIG. 5, their assembly is begun by a reciprocating hammering mechanism indicated generally by the reference character 58. The hammering mechanism includes a plurality of hammers **60*a*, 60*b*, 60*c*, 60*d* and 60*e* which are mounted above the rivet turret 46 and which are reciprocally driven in unison toward and away from the peripheral region of the rivet turret. Each of the hammers 60*a*–60*e* is mounted in alignment with successive of the indexed positions of the turret 46 so that as the turret is indexed to its successive positions, the partially combined rivet and pin will be subjected to the hammering action of each of the hammers in sequence. The first hammer 60*a* is the shortest and drives the pin partly into the rivet. The successive hammers 60*b*–60*e* each are progressively longer and each drives the pin further into the rivet, the last of the hammers 60*e* extending downwardly to an extent sufficient to fully drive the pin into full assembled engagement with the rivet. As the turret 46 continues to be indexed the assembled pin and rivet are expelled from the turret 46 either under the influence of the rotation of the turret or by a stripping device indicated generally at 62.**

FIGS. 3 and 5 show the rivet turret which may be fabricated from a plurality of circular plates. As shown, the rivet turret 46 includes a bottom plate 64 and a top plate 66 which embrace and are spaced apart by a spacer plate 68. The assembly of sandwiched plates 64, 66, 68 may be secured by bolts 70 to a circular flange 72 which is integral with a turret shaft 74. The spacer plate 68 is of smaller diameter than the other plates 64, 66 to define a peripheral groove 76 about the rivet turret 46. The top plate 66 is of smaller diameter than the bottom plate 64 of the turret assembly 46. The top plate 66, as well as the bottom plate 64 each have a plurality of radially extending slots 78, 80 respectively. The slots in the upper and lower plates 66, 64 are aligned with each other and define a plurality of circumferentially spaced radially and outwardly opening grooves 82 which are intersected by the peripheral groove 76. The radial grooves 82 are spaced equiangularly, and in the illustrative embodiment there are twelve such radial grooves spaced at 30° increments. As mentioned, the top plate 66 is of smaller diameter than the bottom plate 64 so that the bottom plate 64 protrudes slightly outwardly from beneath the top plate to define a shoulder 84.

As will be described, the shaft 74 of the rivet turret is driven in 30° increments by an indexing mechanism in the direction shown by the arrow 86 in FIG. 3. The rivet turret 46 is located with respect to the rivet chute 16 so that when the rivet turret has been driven to an indexed position, one of the grooves 82 will be in alignment with the rivet chute 16 to receive the leading rivet from the chute 16. The lower, outlet end of the rivet chute is located with respect to the height of the bottom plate 64 of the rivet turret 46 so that the rivet may slide smoothly onto the shoulder 84 with its tubular portion 28 being disposed within the slot 78 in the top plate 66. With one of the rivets so contained in the rivet turret 46, the indexing mechanism advances the rivet turret to its next indexed position to prevent the next groove 82 to the rivet chute and thus pick up another rivet. The rivets are held in place in their respective grooves 82 by means of a rivet shroud 88 having a circular retaining surface 90 which is spaced slightly from and extends along the outer periphery of the rivet turret 46, from the rivet chute 16 to the location beyond the last hammer 60*e* of the hammering mechanism 58. The rivet shroud 88 insures that the rivets contained within the grooves 82 of the rivet turret 46 will not be ejected from the grooves as the rivet turret is successively indexed to its various positions. The rivet turret thus continues to pick up a rivet from the end of the rivet chute 16 each time the turret 46 is indexed.

The pin turret 52 includes a dish-shaped circular member having a circular bottom wall 92 and a cylindrical side wall 94. The pin turret 52 may be secured to the flange 96 of the pin turret shaft 98 as by bolts 100. The pin turret 52 is mounted so that its bottom wall 92 is disposed slightly above the level of the upper plate 66 of the rivet turret 46. The outwardly facing cylindrical surface of the side wall 94 has a plurality of vertical grooves 102 which extend parallel to the axis of rotation of the turret 52 and which are spaced at 30° increments. The side wall 94 preferably also includes a peripheral groove 104 which circumscribes the side wall 94. Each of the vertical grooves 102 is intended to receive one of the pins and carry the pin to the assembly station 56 as the pin turret 52 is rotatably indexed in the direction shown by the arrow 106 in FIG. 3. The pin turret 52 is located with respect to the pin chute 48 so that for each indexed position of the pin turret 52, one of the grooves 102 will be in alignment with the pin chute 18 to pick off the outermost pin from the L-shaped stop 50.

In order to retain the pins in the respective grooves 102 a pin shroud 108 is mounted in the machine and extends from the pin chute 18 counterclockwise toward the assembly station 56. The pin shroud 108 similarly has a cylindrical surface 110 which is closely spaced to the sidewall 94 of the pin turret 52. As can be seen from FIG. 4, the pin shroud has an inwardly extending ledge 112 at its bottom portion which extends radially inwardly below the bottom wall 92 of the turret 52 to provide support for the lower end of the pins as they are advanced to successive indexed positions. The rivet turret 46 and pin turret 52 thus are driven in equiangular increments to each pick off the outermost rivet and nail from their respective chutes and then bring the nails and rivets into alignment with each other at the assembly station 56 (see FIG. 5) in which the pin is disposed above and in alignment with the rivet. The hammering mechanism 58 then is operated to begin to drive the pin through and into engagement with the rivet.

Figure 3A:
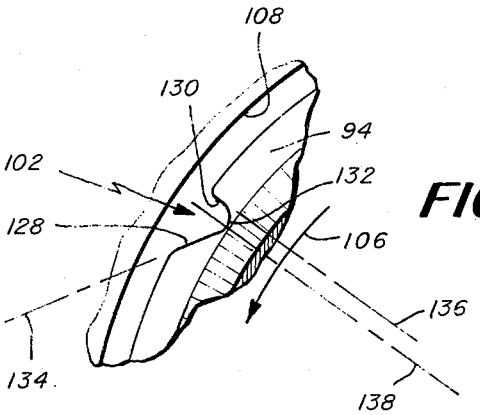
FIG. 3A is a plan illustration of the shape of the pin receiving grooves in the pin turret.

The grooves 102 of the pin turret 52 have a special configuration which facilitates the picking off of the pins from the pin chute 18 and which minimizes any tendency for the pins to become bound or jammed between the the pin turret 52 and the shroud 108. As shown in enlarged FIG. 3A, each of the grooves 102 has two primary walls, an entry wall 128 and a drive wall 130. The drive wall 130 and entry wall 128 join at the bottom of the groove 102 at a smoothly radiused portion 132. The entry wall 128 lies substantially along a plane suggested at 134 which extends outwardly and along the general direction of rotation suggested by the arrow 106. The attitude of the entry wall 128 thus defines a smooth, gradually sloping guide surface along which the pin may smoothly enter the groove 102 from the pin chute 18. The drive wall 130 extends along a plane indicated at 136 which is substantially parallel to but is slightly displaced from a true radial plane suggested at 138. The drive wall 130 imparts a firm direct surface to advance the pin as it is rotatably indexed to its successive positions.

In order to insure that the pin is held in proper orientation at the assembly station 56 with respect to the positioned rivet, means are provided for retaining the pin firmly in its groove 102 and at an elevation which is above the rivet. The pin is held firmly in the groove 102 by a resilient spring finger 114 secured to the end of the pin shroud 108 and which extends toward and into the peripheral groove 104. Thr spring finger 114 serves as an extension of the pin shroud 108 and engages the pin as it is advanced beyond the end of the shroud. The spring finger 114 continually urges the pin 26 into firm engagement with its groove 102. The order to insure that the pin 26 does not drop down as it is advanced from the end of the pin shroud 108 to the assembly station 56, the shroud 108 also carries a resilient ledge extension 116 which provides continued support for the pin after it passes beyond the end of the ledge 112 of the shroud. The resilient ledge extension 116, however, terminates just short of the assembly station. By the time the pin turret 52 has advanced the pin beyond the end of the ledge extension 116, the spring finger 114 bears sufficiently against the pin to preclude the pin from dropping down in its slot 102. The spring finger 114 bears against the side of the pin while the hammer 60a drives the pin downwardly into and through the tubular rivet. The pin is released by the spring finger 114 when the turrets are indexed toward their next position which advances the partly combined pin and rivet past the end of the spring finger 114.

As mentioned above, the pins are not drive through the rivets in a single blow but, instead, are driven in a plurality of successive stages, each stage being effective to drive the pin only a portion of the total distance necessary to fully engage the pin and rivet. This is particularly desirable to insure that the pin and rivet do not become misaligned as a result of the hammering procedure as occurs not infrequently in the prior art devices. As mentioned, it is very important to the proper functioning of the rivet assembly in the rivet gun that the relative shape and configuration of the tubular portion of the rivet is not destroyed. In accordance with the present invention, there are at least three, and preferably five, successive hammers, 60*a*–60*e*, each of which is mounted to and extends downwardly from a carrier 118. The hammers 60*a*–60*e* are mounted to the carrier 58 at spaced locations which are disposed above the assembly station 56 and each of the next succeeding two to four indexed stations (depending on the number of hammers) of the rivet turret 46. Each of the hammers 60*a*–60*e* extends downwardly from the carrier 118 a different extent, with the first hammer 60a being the shortest and the last hammer 60*e* being the longest. Each of the hammers 60*a*–60*e* preferably is threaded to the carrier 118 to enable it to be adjusted heightwise as desired. The first hammer is sufficiently long to drive the pin into the rivet and the last hammer 60*e* is long enough to drive the pin to its final position in the rivet, with the intermediate hammers 60*b*, 60*c* and 60*d* being of progressively increasing intermediate lengths. In addition, further assurance that the pin and rivet will be combined in proper axial alignment is obtained by forming the downwardly facing surfaces of at least the first two hammers 60*a*, 60*b* to define a concave surface as suggested at 120. When the concave surface of the hammer engages the head end of the pin, even if there is some misalignment between the pin and rivet, the concave surface 120 of the hammer will tend to urge the pin to its registered axial position. If desired, one or more of the hammers may have an enlarged hammering head 121 at its lower end, the bottom surface of the head 121 being concave and presenting an enlarged surface to insure that a misaligned pin will be urged back to an aligned position.

The hammers 60*a*–60*e* are operated in unison, the carrier 118 being mounted for vertical reciprocating movement. The carrier 118 is secured to the upper end of a reciprocating rod 122 which is slideably mounted to the frame of the machine. The rod is reciprocated in timed relation to the rotation of the turrets so that the hammers are reciprocated in unison, first downwardly and then back to their upper, remote position while the turrets remain at their indexed position.

From the foregoing it will be understood that after the pin has been partly driven into the rivet at the assembly station 56 and after the turrets have been partly rotated toward their next indexed position, with the pin being advanced beyond the end of the spring finger 114, the pin is supported wholly and entirely by the rivet and is carried with the rivet by the rivet turret 46 to be sequentially presented to the succeeding hammers. The pin will not tend to fall of its own weight down through the rivet because of the relatively rapid acceleration and deceleration forces applied to the pin as it is indexed together with the rivet turret 46. It may be noted that the forces of acceleration and deceleration tend to dislocate the pin and urge it out of axial alignment with the rivet and the hammer configuration described above is intended to urge the pin back into alignment and to drive the pin in axial alignment with the rivet. The rivet shroud 88 which extends continuously about the rivet turret 46 terminates just beyond the indexed position of the last of the hammers 60*e*. The fully assembled pin and rivet usually is ejected as the rivet turret 46 is advanced to its next indexed position beyond the last hammer under the influence of the centrifugal force applied to the rivet assembly as the rivet assembly passes beyond the end of the shroud 88. In the event that the rivet assembly, for some reason, is not automatically ejected, the stripping device 62 engages the rivet as it continues to be advanced with the turret 46 and urges the rivet out of the groove 82. Whether the rivet assembly is ejected solely under the influence of centrifugal force or is stripped off by the stripping device 62, it will follow a path toward a receiving chute or packing container.

The stripping device 62 may consist simply of a relatively thin plate 124 which is mounted to the table 22 and which extends transversely into the peripheral groove 76 of the rivet turret 46 sufficiently to engage the tubular portion 28 of a rivet which is advanced to the plate 124. The plate 124 has a stripping edge 126 which extends at an angle with respect to the advancing rivet assembly as to engage the rivet smoothly and cause the rivet assembly to be wedged radially and outwardly from its groove 82 in the turret 46.

Figure 4:
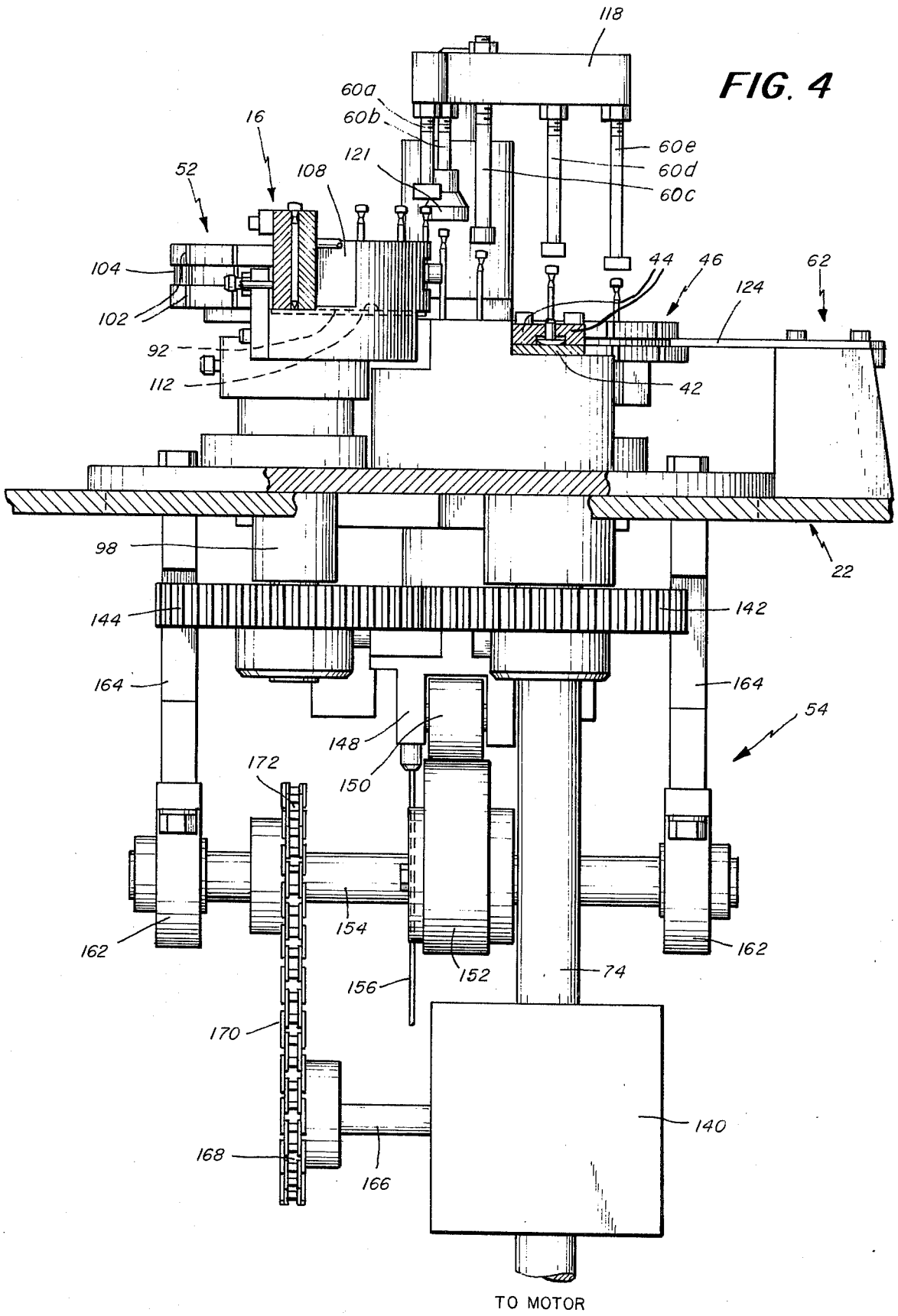
FIG. 4 is a sectional elevation of the machine as seen along the line 4—4 of FIG. 3.
Figure 8:
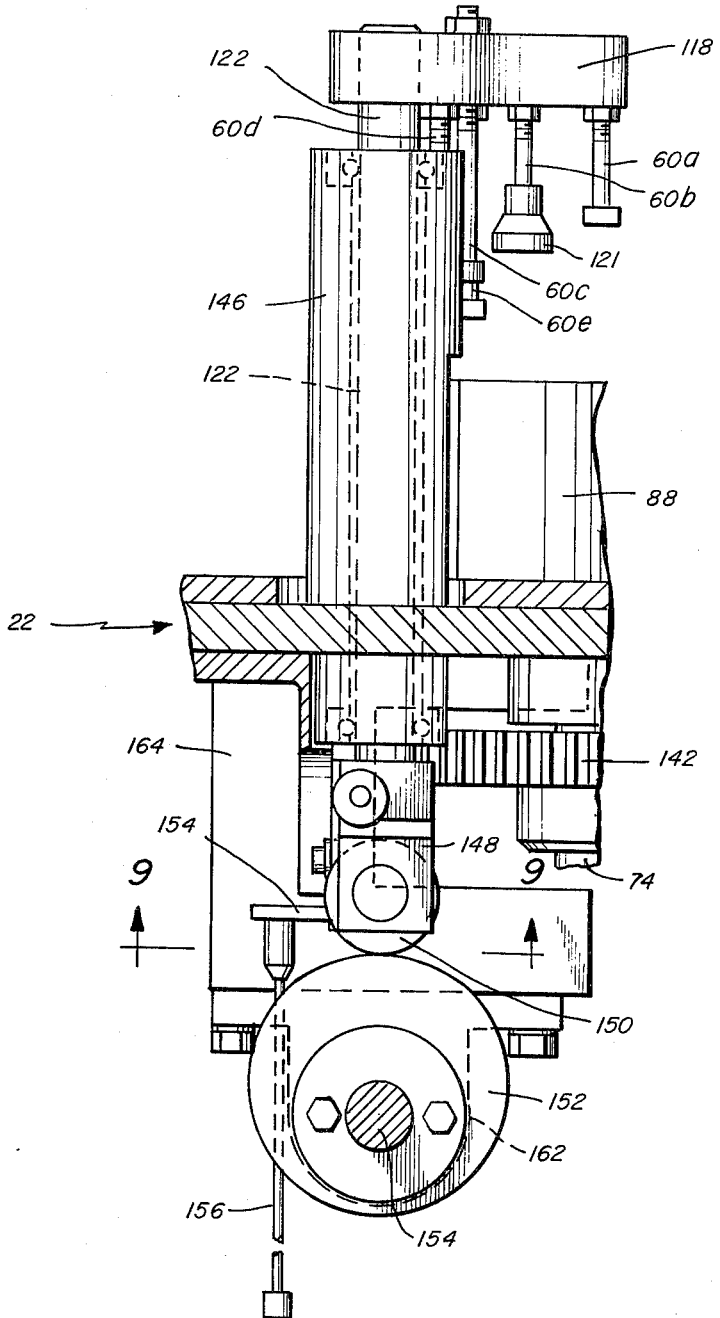
FIG. 8 is a sectional elevation of a portion of the turret assembly as seen along the line 8—8 of FIG. 3.
Figure 9:
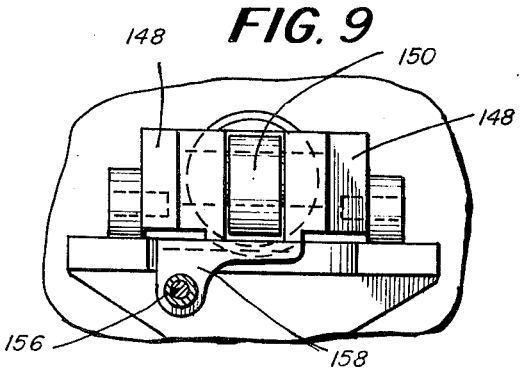
FIG. 9 is a sectional elevation of the drive mechanism for the hammering mechanism as seen along the line 9—9 of FIG. 8.

The drive mechanism for the machine is housed within the frame and is shown in FIGS. 4, 8 and 9. It includes a motor (not shown) which drives an indexing mechanism 140. The indexing mechanism 140 is of the type which converts continuous rotary motion to intermittent rotary motion such as a geneva mechanism or the like. The output shaft of the indexing mechanism 140 may be the turret shaft 74 which is connected directly to the rivet turret 46 as shown in FIG. 5. A gear 142 is secured to the shaft 70 for rotation therewith and meshes with a gear 144 which in turn is secured to the lower end of the drive shaft 98 for the nail turret 52. Thus, as gear 142 is rotated at 30° increments, it similarly drives gear 144 in like increments to rotate the rivet turret 46 and pin turret 52 in the directions described above.

The hammering mechanism 58 is driven in timed relation to the indexing of the turrets 46, 52. As described, the hammers normally are in an upward idle position. When the turrets have been indexed, the hammer mechanism 58 then is advanced downwardly in a hammering stroke and then upwardly toward its idle position in readiness for the next hammering stroke after the turrets are again indexed. To this end, the rod 122 which supports the hammer carrier 118 is mounted for vertical reciprocating movement in a sleeve 146 which is, in turn, secured to the table 22. The lower end of the rod 122 extends downwardly beyond the lower end of the sleeve 146 and a yoke 148 is secured to the lower end of the rod 122. A cam follower 150 is rotatably mounted to the yoke and bears against an eccentric cam 152 which is mounted on rotatable shaft 154. The rod 122 is biased downwardly to maintain the cam follower 150 in continuous contact with cam 152 so that as cam 152 is rotated, it controls the vertical position of the hammering mechanism. In the illustrative embodiment rod 122 is biased downwardly by a cable 156 which is secured to the yoke 148, as by a bracket 158. The lower end of the cable 156 is connected to the piston rod of a pneumatic cylinder 160 which is arranged to apply a continuous downwardly biasing force to the cable 156. The cam shaft 154 extends transversely within the frame and is supported at its opposite ends by bearings 162 which are rigidly suspended from the underside of the table 22 by brackets 164. The cam shaft 154 is driven by a continuous output shaft from the indexing mechanism 140. The output shaft 166 carries a drive sprocket 168 which is connected by a chain 170 to a driven sprocket 172 mounted to the cam shaft 154. The various gear ratios and configurations of the cam 152 are selected to effect the desired reciprocating hammering stroke for the hammering mechanism for each indexing of the turrets.

It should be understood that the foregoing description of the invention is intended merely to be illustrative thereof and that other embodiments and modifications may be apparent to those skilled in the art without departing from its spirit.

Having thus described the invention, what I desire to claim and secure by Letters Patent is:

1. A machine for assembling the pin and tubular rivet of a blind rivet assembly comprising:

a frame;

a rivet turret mounted to the frame for rotation about an axis, the rivet turret having a plurality of circumferentially equiangularly spaced rivet-receptive openings formed about its periphery, each of the openings being of a configuration to enable a pin to be passed through the rivet while the rivet is disposed in the opening;

a pin turret mounted to the frame for rotation about an axis parallel to the axis of rotation of the rivet turret and having a plurality of circumferentially and equiangularly spaced pin-receptive grooves formed about its periphery, the pin turret being located above the rivet turret and in a position in which the rivet and pin carried by said turrets may be brought into substantially axial alignment at an assembly station;

drive means for rotatable indexing of each pin and rivet turrets in unison and in angular increments to enable a succession of rivets and pins to be aligned at the assembly region;

a series of hammers mounted to the frame above the rivet turret for movement toward and away from the rivet turret, the first of said hammers being disposed above and in alignment with the assembly region, the remaining of the hammers in the series being located at each of the successive indexed positions of the rivet turret, the hammers being arranged so that the first may drive the pin into the rivet and the successive hammers may each drive the pin partly through the rivet, the last of the hammers in the series being arranged to drive the pin fully into the rivet; and means for operating said hammers in a hammering stroke while the rivet turret is at rest at an indexed position.

2. A machine as defined in claim 1 further comprising:

at least some of the hammers having a hammering surface of concave configuration.

3. A machine as defined in claim 1 further comprising:

said hammers being operated in unison to drive all of the pins which are in alignment with said hammers simultaneously.

4. A machine as defined in claim 1 wherein there are at least three of said hammers.

5. A machine as defined in claim 1 further comprising:

each of said hammers being longitudinally adjustable.

6. A machine as defined in claim 1 wherein said hammers are mounted to the machine by means comprising:

a post mounted for reciprocating movement along an axis parallel to the axes of rotation of said turret;

said hammers being mounted to the upper end of the post and extending downwardly therefrom toward said indexed positions of the rivet turret;

means for biasing the post downwardly in a direction to urge the hammers toward the rivet turret;

cam means operatively associated with post for controlling the vertical position of the post; and means for driving said cam means in timed relation to the indexing of the turrets to urge the post and hammers carried thereby downwardly in a hammering stroke while the rivet turret is at rest at an indexed position and to thereafter raise the post to withdraw the hammers before the rivet turret is advanced to its next indexed position.

7. In a machine for assembling the pin and tubular rivet of a blind rivet assembly, the machine including a frame, a pin turret rotatably mounted to the frame, the pin turret having a plurality of pin-receptive grooves circumferentially spaced about its periphery, the pin turret being mounted with respect to an assembly station and the outlet of a pin chute to pick up a pin from the pin chute and advance it to the assembly station, the improvement comprising:

a shroud extending circumferentially about and in closely spaced relation to the periphery of the pin turret from the end of the pin chute and terminating short of the assembly station; and means for maintaining the pin in its groove at the assembly station and comprising a resilient finger mounted to the terminal end of the shroud and extending slightly beyond the assembly station, the finger extending inwardly toward the periphery of the pin turret to engage the pin intermediate its ends and to urge the pin radially inwardly into its receiving groove.

8. A machine as defined in claim 7 further comprising:

the shroud including a ledge extending circumferentially beneath the pin turret to provide a support for the lower end of the pin, the ledge terminating short of the assembly station; and a finger extending from the terminal end of the ledge to a location just short of the assembly station, the finger defining an extension of the ledge to insure proper heightwise positioning of the pin as it approaches the assembly station.

9. A machine as defined in claim 8 further comprising:

said resilient extension of said shroud being constructed to urge the pin in its receptive groove under a continually increasing force of a magnitude such that when the pin passes beyond the end of the ledge extension, the forces of the shroud extension on the pin will be sufficient to hold the pin in the groove at its proper height therein.

* * * * *